US012268288B2

(12) United States Patent
Alexander-Ashley

(10) Patent No.: US 12,268,288 B2
(45) Date of Patent: Apr. 8, 2025

(54) FLEXI HAIR CURLER

(71) Applicant: Belinda Marie Alexander-Ashley, Fort Worth, TX (US)

(72) Inventor: Belinda Marie Alexander-Ashley, Fort Worth, TX (US)

( * ) Notice: Subject to any disclaimer, the term of this patent is extended or adjusted under 35 U.S.C. 154(b) by 196 days.

(21) Appl. No.: 18/055,840

(22) Filed: Nov. 16, 2022

(65) Prior Publication Data

US 2024/0156229 A1 May 16, 2024

(51) Int. Cl.
*A45D 2/18* (2006.01)

(52) U.S. Cl.
CPC ..... *A45D 2/18* (2013.01)

(58) Field of Classification Search
CPC ... A45D 2/04; A45D 2/06; A45D 2/08; A45D 2/10; A45D 2/122; A45D 2/14; A45D 2/16; A45D 2/18; A45D 2/20; A45D 2/24; A45D 2/125; A45D 2/143; A45D 2/145; A45D 2/146; A45D 2/148; A45D 2/2407; A45D 2/2414; A45D 2/2442; A45D 2/245; A45D 2/2457; A45D 2/2464; A45D 2/2485; A45D 8/14; A45D 8/20; A45D 8/24; A45D 8/34
See application file for complete search history.

(56) References Cited

U.S. PATENT DOCUMENTS 2,473,115 A * 6/1949 Vaughn ..... A45D 2/2442 D28/37
3,204,645 A * 9/1965 Sidelman ..... A45D 2/24 132/258
3,417,760 A * 12/1968 Silver ..... A45D 2/122 132/256
3,433,233 A * 3/1969 Thackeray ..... A45D 2/122 132/251
2020/0383447 A1* 12/2020 Williams ..... A45D 2/08

* cited by examiner

*Primary Examiner* — Cris L. Rodriguez
*Assistant Examiner* — Karim Asqiriba

(57) ABSTRACT

A one-piece flexible hair curler assembly used for day and night use comprising a collapsible body, elongated extensions at right angles on its distal ends with attached protuberances that hold the assembly securely in place. The flexi hair curler assembly is fabricated of lightweight, moisture and heat resistant, flexible material including silicone. To use, the appendages are flexed away from the curler body as the hair is wound around the core. After reaching the desired position, the appendages are released, and the protuberances hold the apparatus in place without the aid of additional hair fasteners or clips. The curler molds to the wearer's head and scalp for maximum comfort while remaining secure to facilitate the setting of curls in the hair. Unlike other hair curlers or rollers, the flexible curler system is comfortable, secure and cost effective.

4 Claims, 1 Drawing Sheet

Figure 1
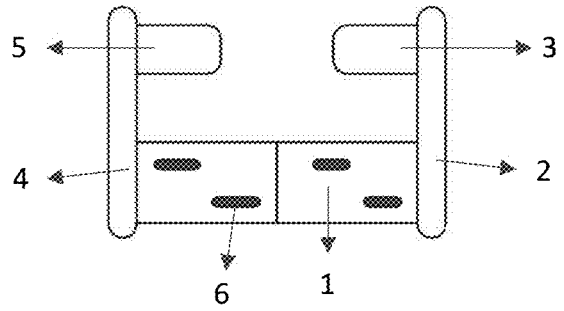
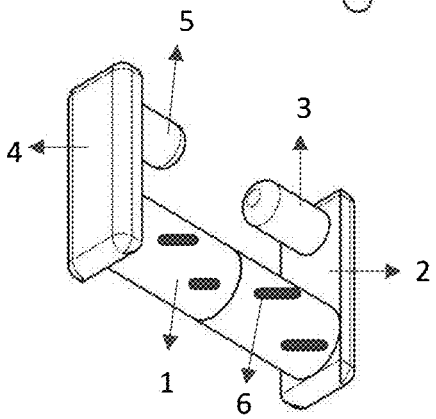
Figure 2
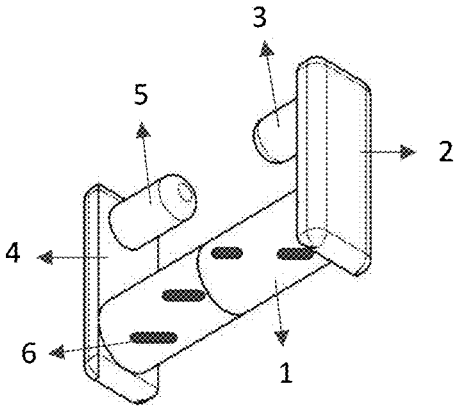
Figure 3

FLEXI HAIR CURLER

CROSS-REFERENCE TO RELATED APPLICATIONS

| | Pat. No. | Patent Date | Patent Name |
|---|---|---|---|
| 1 | 3,937,233 | Feb. 10, 1976 | Hair curler assembly |
| 2 | 6,708,698 B2 | Mar. 23, 2004 | Curer for hairstyles and permanent waves |
| 3 | 4,834,118 | May 30, 1989 | Heatable flexible hair curlers |
| 4 | 7,195,020 B2 | Mar. 27, 2007 | Hair curler roller with retaining clamp and in particular, for overnight use |
| 5 | 5,819,763 | Oct. 13, 1998 | Microwavable hair curlers |

STATEMENT REGARDING FEDERALLY SPONSORED RESEARCH AND DEVELOPMENT: N/A

BACKGROUND OF THE INVENTION

Field of the Invention

The present invention relates generally to hair curlers/rollers. Specifically, the present invention discloses a hair roller/curler of improved design which incorporates the features of a vented one-piece core that allows moisture to wick away from hair and heat to pass through to the hollow core, and about which two flexible appendages are oriented at either distal end that flex to hold hair securely in place after being wound around the body. The appendages with associated protuberances at right angles and parallel to the core flex away from the body of the roller to allow hair to be would around the core and appendages released to hold hair securely and comfortably for day and night wear.

Description of the Prior Art

The prior art is well documented with examples of hair rollers/curlers. The main purpose of such rollers/curlers are to provide a stylish curl pattern without the incidence of frizzing, tangling, or damage resulting in hair breakage.

U.S. Pat. No. 3,937,233, issued to Hook, discloses an elongated, generally cylindrical roller body with a hollow member having one closed end, with the end wall having a small central aperture. The body being fabricated of a lightweight, heat insulating material such as Styrofoam. The fastening member secured in the body end wall aperture, having a hook at the opposite end of the strap to be hooked over the body lip at the open end. The main purpose of the hair curler assembly is to provide hair curling with maximum convenience to the wearer and the hairdresser.

U.S. Pat. No. 6,708,698 B2, to Catini, provides a curler for hairstyles and permanent waves including an elongated body with cross sections including an elliptical profile and changing continuously from a minimum to a maximum extension, in relation to a selected rate. The body having opposing ends and intermediate and central portions situated between the heads. An elastic strap being stretched longitudinally to the curler body creating a space for the hair to pass through. The primary purpose of the curler is to create hairstyles and permanent waves.

U.S. Pat. No. 4,834,118 to Goeller, comprises an elongated, flexible hair curler having a central core molded within a pliable viscoelastic polymer heat-retaining body and rounded ends capable of being bent into a plurality of positions. The heat retaining body capable of being heated by an external means to a predetermined temperature to facilitate curls in the hair.

U.S. Pat. No. 7,195,020 B2, to Bird, comprises a hair roller with a and spool-shaped core. The foam outer layer is applied about an exterior surface associated with the core, said outer layer further including a smooth fabric satin covering. A clamp mechanism secured about an annular surface associated with the spool-shaped core, the clamp mechanism includes inwardly directed and extended serrated edges. The clap mechanism sandwiches a user's hair around the outer layer of the body to be comfortably worn over night, providing a smooth curl appearance, and preventing hair breakage.

U.S. Pat. No. 5,819,763 to Hallowell II, comprises a strip of fabric having a central portion containing a cushion formed of resilient material, such as foam rubber, and having a central core formed of microwavable material. The microwavable hair rollers are directed to improve hair curlers which can be heated in the microwave.

BRIEF SUMMARY OF THE PRESENT INVENTION

The present invention discloses a hair curler roller incorporating the features of a one-piece flexible, cylindrical shaped core fabricated from material including silicone with appendages at its distal ends which flex to hold the roller securely and comfortably to the hair. The vented body is comprised of flexible and collapsible material including silicone that wicks away moisture and allows heat to pass through into the hollow core. The elongated appendages affixed at the distal ends of the core flex with its associated protuberances during hair rolling to hold hair securely when released. The present invention improves upon the roller design providing a convenient one-piece design used for curly hairstyles or permanent waves, maximizing comfort with the collapsible core, flexible appendages, and associated protuberances capable of a plurality of positions.

The flexible appendages located at the distal ends of the core are constructed of flexible material including silicone or rubber to be both durable and flexible while hair is wound around the cylindrical, collapsible body, which is stiff enough to retain its original shape to secure the hair in place. When hair is would around the core and the desired location of the roller is placed, the appendages are released to hold the assembly securely in place. The flexible hair curler does not pull or damage hair strands and is fabricated with light weight material fabricated from material including silicone or rubber.

During overnight use, the roller curler collapses to form to the wearer's head for comfortable wear. In addition, venting used in the construction of the core allows moisture to wick away from the hair and heat to pass through to the hollow core to assist with hair drying and smooth styling.

Unlike other designs that feature stiff rods requiring fasteners and clips that pull or damage hair, the flexi hair curler features a convenient one-piece design that molds to hair and scalp, comfortable for night and day wear, and constructed of material including silicone that collapses to mold to the hair and head of wearer, and capable of a plurality of positions. The structure of the flexi curler body is firm, but not stiff, in its construction so that it collapses and molds to the hair and scalp of the user.

Reference will now be made to the attached drawings, when read in combination with the following detailed description, wherein like reference numerals refer to like parts throughout the several views, and in which:

FIG. 1 shows a side view of the current invention with its one-piece cylindrical body, elongated appendages at right angles on its distal ends with attached flexible protuberances parallel to the body.

FIG. 2 illustrates a northwest angled view of the present invention comprising the cylindrical body, distal appendages at right angles with attached protuberances affixed parallel to the body.

FIG. 3 illustrates a northeast angled view of the current invention comprising the one-piece cylindrical body, distal appendages at right angles with attached protuberances affixed parallel to the body.

DETAILED DESCRIPTION AND BEST MODE OF IMPLEMENTATION

Referring to FIGS. 1-3 in combination, a series of perspective views of the Flexi Hair Curler are illustrated. As described previously, the current one-piece invention is collapsible and flexible to promote comfortable wear night or day, repels water to encourage hair drying, smooth edges resist hair damage, allowing heat to pass through the hollow core. The flexible hair curler assembly comprising:

- a generally hollow, cylindrical body, noted as [1], having elongated appendages oriented at the distal ends, noted as [2] and [4], small holes [6] along the core, to allow for passage of water and heat, and capable of movement in a plurality of positions.
- said elongated appendages, [2] and [4], having protuberances, noted as [3] and [5], at right angles on the lateral surfaces parallel to the body; and
- said flexible curler assembly fabricated from a lightweight, flexible material including silicone, which embodies characteristics such as flexibility, durability, and resistance to heat degradation and water absorption.

The cylindrical, flexible body collapses to mold to the wearer's hair and head. To use, the flexible appendages at the distal ends, [2] and [4], of the curler body including the attached protuberances, [3] and [5], are flexed away from the roller body [1] as the hair is wound around the core and released when the desired position is reached. The protuberances, [3] and [5], hold the flexible hair curler securely in place.

Some other roller designs use stiff rods that pull or stretch the hair during overnight use causing discomfort or hair damage. Additionally, some designs require clips and fasteners that may be uncomfortable for night use or fail to securely hold the hair in place over a longer period.

The invention claimed is:

1. A flexible hair curler assembly for day and night use consisting of:

- a generally hollow, cylindrical, elongated core body;
- vented openings along lateral surfaces of the core;
- elongated rectangular-shaped appendages situated at distal ends of the core capable of movement in a plurality of positions;
- said elongated rectangular-shaped appendages having attached cylindrical-shaped protuberances at right angles situated parallel to the core; and
- said flexible hair curler assembly fabricated from a lightweight, moisture resistant, flexible material including silicone.

2. The flexible hair curler assembly as described in claim 1, further comprising a specified space and size.

3. The flexible hair curler assembly as described in claim 1, wherein said cylindrical-shaped protuberances being of lesser width and length than the core body and rectangular-shaped appendages.

4. The flexible hair curler assembly as described in claim 1, a one-piece hair curler exhibiting a specified shape and size, said rectangular-shaped appendages extending from distal ends of the curler and associated said cylindrical-shaped protuberances that flex to accommodate hair being wound on the core body before release to secure it in place.

* * * * *